United States Patent [19]

Smith

[11] Patent Number: 5,048,575

[45] **Date of Patent: * Sep. 17, 1991**

[54] STRAP TENSIONING AND CUT OFF TOOL

[75] Inventor: Lester N. Smith, Annandale, Minn.

[73] Assignee: Malco Products, Inc., Annandale, Minn.

[ * ] Notice: The portion of the term of this patent subsequent to Aug. 14, 2007 has been disclaimed.

[21] Appl. No.: 566,629

[22] Filed: Aug. 13, 1990

Related U.S. Application Data

[63] Continuation-in-part of Ser. No. 306,299, Aug. 14, 1990, Pat. No. 4,947,901.

[51] Int. Cl.[5] ..... B21F 9/00

[52] U.S. Cl. ..... 140/93.2; 140/123.6

[58] Field of Search ..... 140/93.2, 123.5, 123.6; 403/327, 329

[56] References Cited

U.S. PATENT DOCUMENTS

| | | | |
|---|---|---|---|
| D. 306,390 | 3/1990 | Dyer . | |
| 3,154,114 | 10/1964 | Bailey . | |
| 3,168,119 | 2/1965 | Schwester et al. . | |
| 3,169,560 | 2/1965 | Caveney et al. . | |
| 3,173,456 | 3/1965 | Bailey . | |
| 3,254,680 | 6/1966 | Caveney et al. . | |
| 3,332,454 | 7/1967 | Lawson et al. . | |
| 3,344,815 | 10/1967 | Lawson et al. . | |
| 3,433,275 | 3/1969 | Eppler . | |
| 3,515,178 | 6/1970 | Hidassy . | |
| 3,645,302 | 2/1972 | Caveney et al. | 140/123.6 |
| 3,661,187 | 5/1972 | Caveney et al. . | |
| 3,782,426 | 1/1974 | Morgan et al. . | |
| 3,909,884 | 10/1975 | Weckesser . | |
| 3,986,642 | 10/1976 | Selvia et al. . | |
| 3,993,109 | 11/1976 | Fortsch . | |
| 4,093,005 | 6/1978 | Eberhardt et al. . | |
| 4,202,384 | 5/1980 | Aubert . | |
| 4,495,972 | 1/1985 | Walker . | |
| 4,541,146 | 9/1985 | Giannone . | |
| 4,548,242 | 10/1985 | Paradis . | |
| 4,580,319 | 4/1986 | Paradis . | |
| 4,602,418 | 7/1986 | Bone et al. . | |
| 4,627,562 | 12/1986 | Bone . | |
| 4,632,247 | 12/1986 | Moody et al. . | |
| 4,640,319 | 2/1987 | Walker . | |
| 4,640,320 | 2/1987 | Avison et al. . | |
| 4,651,913 | 3/1987 | Bone . | |
| 4,658,478 | 4/1987 | Paradis . | |
| 4,733,701 | 3/1988 | Loisel et al. . | |
| 4,754,529 | 7/1988 | Paradis . | |
| 4,778,095 | 10/1988 | Bone . | |
| 4,788,751 | 12/1988 | Shely et al. . | |
| 4,790,225 | 12/1988 | Moody et al. . | |
| 4,793,385 | 12/1988 | Dyer et al. . | |
| 4,862,928 | 9/1989 | Caveney et al. . | |
| 4,866,816 | 9/1989 | Caveney . | |
| 4,866,817 | 9/1989 | Espevik et al. . | |
| 4,900,064 | 2/1990 | Lyons et al. . | |
| 4,947,901 | 8/1990 | Rancour et al. | 140/123.6 |

OTHER PUBLICATIONS

TY-RAP Cable Ties, Thomas Betts Corporation.
Catamount Product Bulletin, Catamount Mfg., Inc.
Tytontwyster Cable Tie Tool, Tyton Corporation.
PANDUIT Installation Tools, Panduit Corp., Mechanical Group.
Duro Dyne Distributor Price List, Duro Dyne Corp.
All-States Product Bulletin, Nylon Duct-Clamps, All-States Inc.

*Primary Examiner*—Lowell A. Larson
*Attorney, Agent, or Firm*—Palmatier & Sjoquist

[57] ABSTRACT

A tensioning and cut off tool for applying a strap to a bundle or to circular flexible air duct which is being joined to circular metal duct work. The tool includes a quick release operating mechanism to suddenly cut the strap when a predetermined force is applied to the handles of the tool, and further includes an adjustment means for adjusting the predetermined force for cutting the strap. An improved strap engaging mens is also disclosed that includes a discontinuous edge that engages the strap during the gripping and tensioning of the strap of minimizing the chances of a severing of the strap by the strap engaging means.

14 Claims, 3 Drawing Sheets

STRAP TENSIONING AND CUT OFF TOOL

This application is a continuation-in-part of patent application Ser. No. 306,299 which will issue on Aug. 14, 1990 as U.S. Pat. No. 4,947,901.

BACKGROUND OF THE INVENTION

The present invention relates to hand tools and more particularly to tensioning and cut off tools for binding straps with locking collars.

A strap tensioning and severing tool having a complicated operating mechanism is shown in the Caveney et al. U.S. Pat. No. 3,661,187 issued May 9, 1972 and assigned to Panduit Corporation of Tinley Park, Ill. It discloses a gripper mechanism which transmits force from an actuator link, to a drive link, to a lever link, to a tension rod on which the gripper is pivotally mounted. A severing mechanism transmits force from the actuator link, to the drive link, to the lever link, to a pair of link plates, and finally to a detent member which in turn allows the link plates to pivot from their normal positions. Pivoting of the link plates causes a lever arm to pivot and raise a blade to sever a strap. The strap is severed between an abutment plate and the gripper.

SUMMARY OF THE INVENTION

A feature of the present invention is a strap tensioning and cut off tool having relatively swingable handles to produce the tensioning, and wherein one of the handles includes a support arm for a blade and a pressure lever tiltably connected to the arm to move the blade and cut the strap with a snap action when a predetermined force is applied to the handles, and wherein the articulating handle includes an adjustment means for adjusting the tension at which the strap is cut.

Another feature is the provision in such a strap tensioning and cut off tool, of the adjustment means engaging a spring pressed ball detent means connecting the support arm and pressure lever for adjustably and releasably retaining the support arm and the pressure lever in the tiltable relationship.

Another feature of the invention is a strap tensioning and cut off tool wherein relatively swingable handles are squeezed together to sequentially produce tensioning of the strap, cutting with a snap action when a certain tension in the strap is exceeded, and resetting of the tool as the handles are released for the next strap tensioning and cut off operation, and wherein one of the handles includes an adjustment means for adjusting the tension at which the strap is cut.

Another feature is the provision in such a strap tensioning and cut off tool with a quick lease operating mechanism to cut the strap when a predetermined force is applied to the tool handles, of a strap engaging means with an edge that engages the strap during the gripping and tensioning of the strap and wherein the edge is discontinuous to minimize a severing of the strap by the strap engaging means.

Another feature is the provision in a strap tensioning and cut off tool having a non-tension mechanism for producing a cutting of the strap that may be operated without regard to the tension being applied to the strap, of a strap engaging means with an edge that engages the strap during the gripping and tensioning of the strap and wherein the edge is discontinuous to minimize a severing of the strap by the strap engaging means.

An advantage of the present invention is that the strap tensioning and cut off tool may be customized on-site to meet the prerequisites of a particular bundling or duct work operation. Accordingly, the tool is immediately suited for strapping hard or soft, deformable goods.

Another advantage is that the strap engaging means bites firmly into the strap during gripping and tensioning of the strap without prematurely severing the strap.

DESCRIPTION OF THE PREFERRED EMBODIMENT

Figure 1:
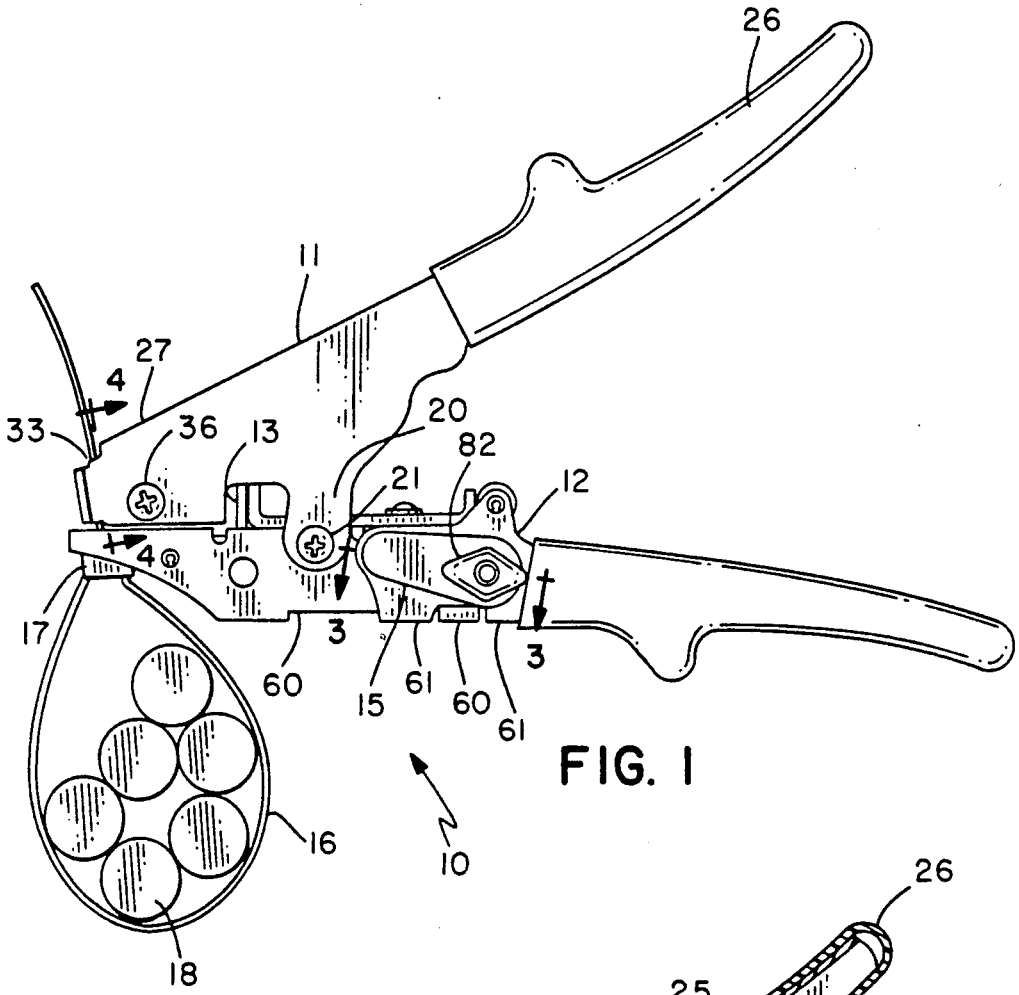
FIG. 1 is a side elevation view of the strap tensioning and cut off tool with a quick release operating mechanism for cutting a strap.
Figure 2:
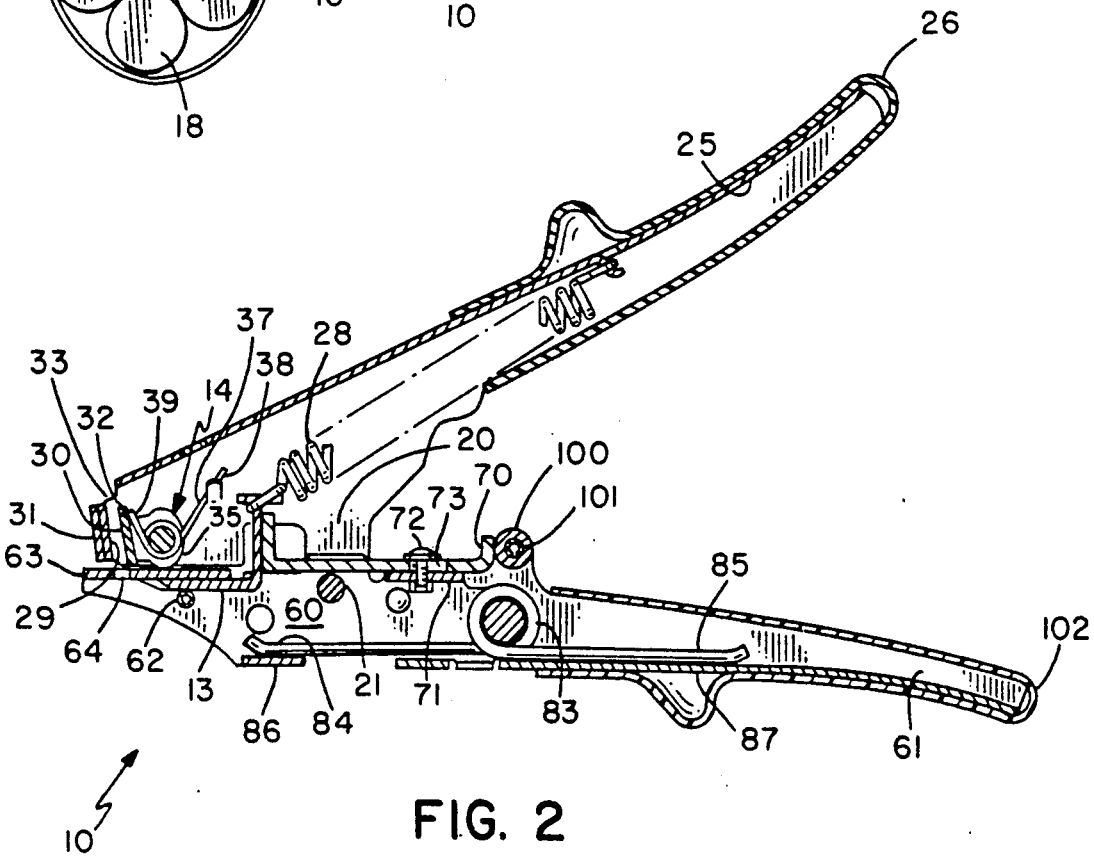
FIG. 2 is a section view of the strap tensioning and cut off tool of FIG. 1.
Figure 3:
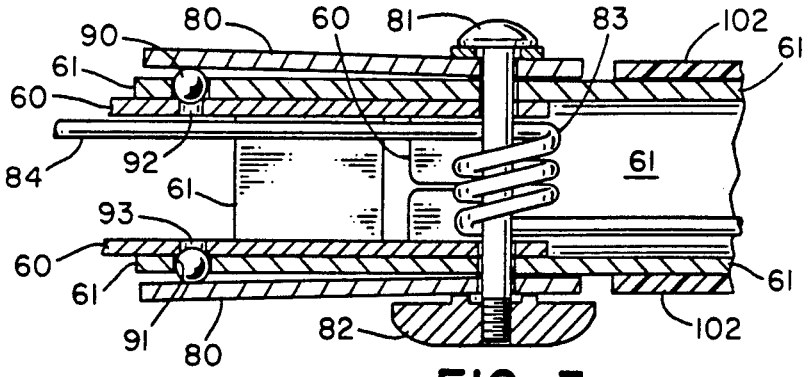
FIG. 3 is a section view at lines 3—3 of FIG. 1.
Figure 4:
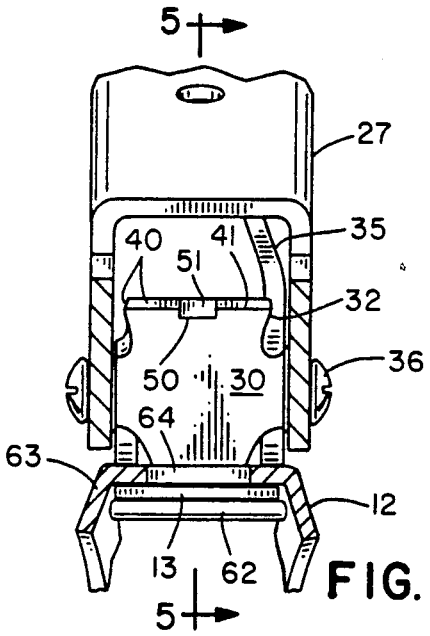
FIG. 4 is a section view at lines 4—4 of FIG. 1.
Figure 5:
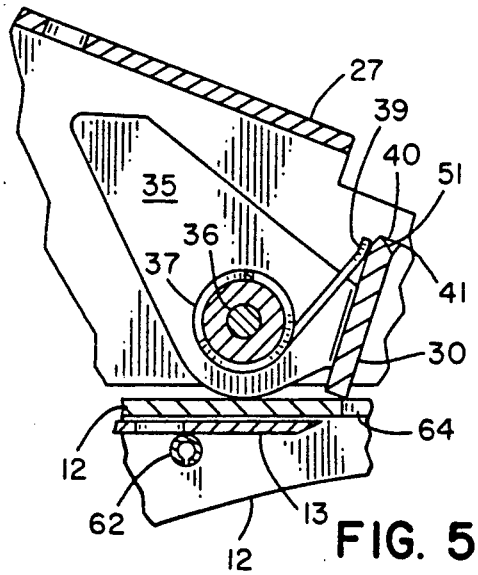
FIG. 5 is a section view at lines 5—5 of FIG. 4.
Figure 8:
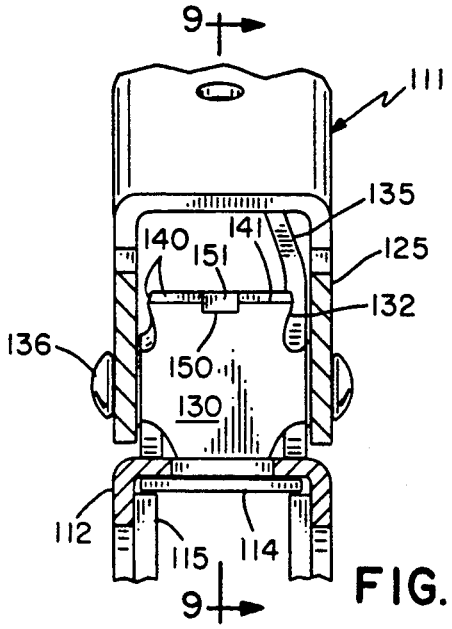
FIG. 8 is a section view at lines 8—8 of FIG. 6.
Figure 9:
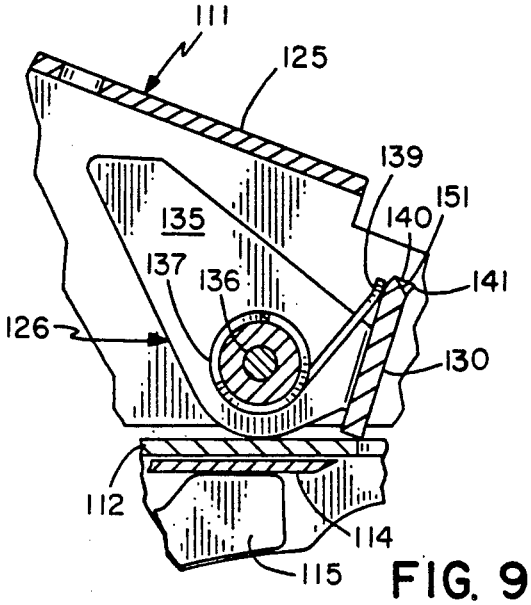
FIG. 9 is a section view at lines 9—9 of FIG. 8.
Figure 6:
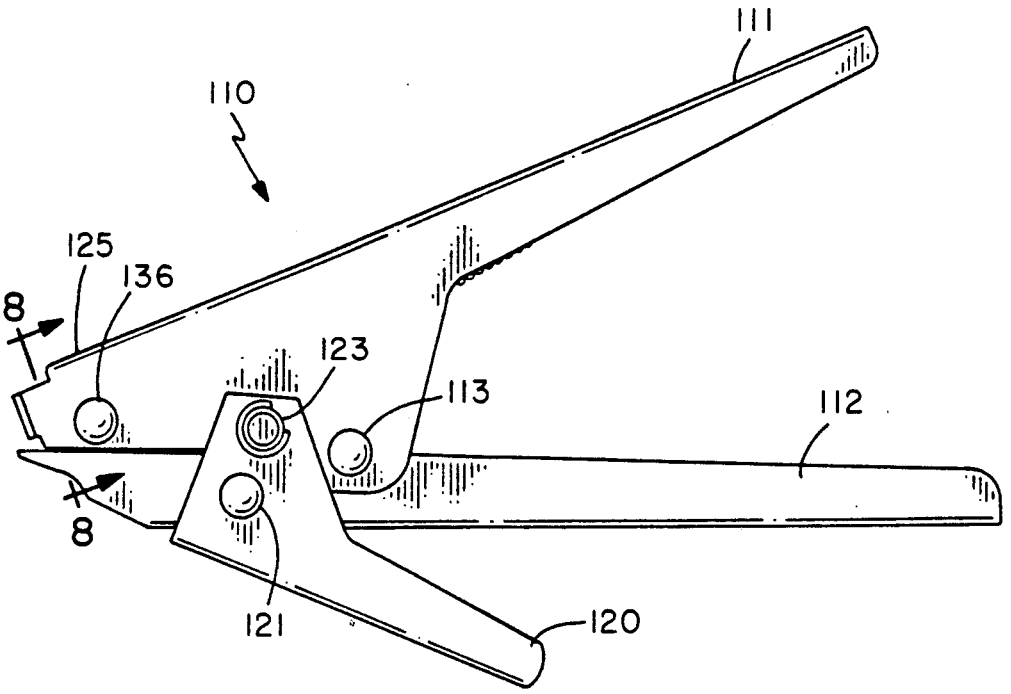
FIG. 6 is a side elevation view of the strap tensioning and cut off tool with a manual cut off mechanism for cutting a strap.
Figure 7:
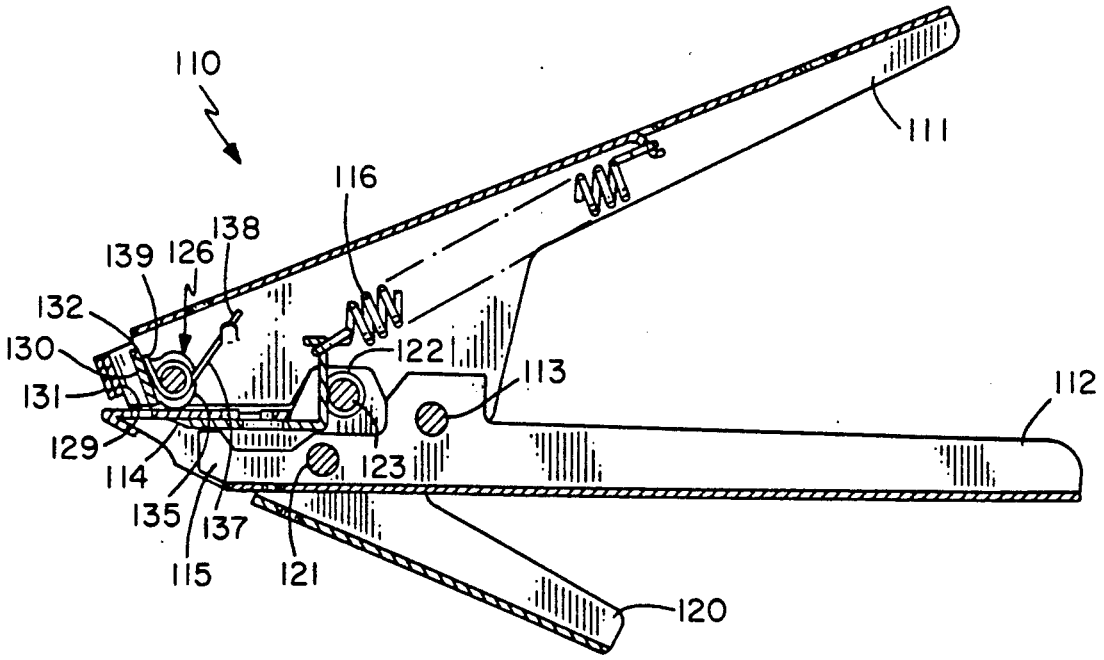
FIG. 7 is a section view of the strap tensioning and cut off tool of FIG. 6.

As shown in FIGS. 1 and 2, a tensioning and cut off tool is generally indicated by the reference numeral 10. Its principal components include a pair of handles 11, 12, a cut off blade 13, strap engaging means 14, and a quick release operating mechanism 15. The tool 10 tensions a strap 16 with a locking collar 17 about a bundle of elements 18 and cuts the strap 16 when a prescribed tension, set by the quick release operating mechanism 15, causes the handle 12 to articulate and operate the cutting blade 13 to cut the strap 16. As well as bundling elements 18 such as cables, the tool 10 is utilized for tensioning and cutting straps 16 which join insulated or uninsulated circular flexible air duct to circular metal duct work.

The present tensioning and cut off tool 10 is similar to the tool disclosed in patent application Ser. No. 306,299 which will issue on Aug. 14, 1990 as U.S. Pat. No. 4,947,901. This application is hereby incorporated by reference.

The handle 11 is a channeled piece with a pair of pivot mounts 20 extending to either side of the channeled handle 12. A pin connector 21 extends through the pivot mounts 20 and handle 12 to swingably affix the handles 11, 12.

The handle 11 includes a rear end 25 with a grip 26 and front end 27 housing the strap engaging means 14. A coil spring 28 is affixed to and extends from the rear end 25 to the front end 27 where is affixed to the cutting blade 13. The strap 16 extends through the front end 27 and more specifically between the respective, opposing, planar surfaces 29, 30 of a double plate 31 of the front end 27 and a plate 32 of the strap engaging means 14. The strap 16 exits the front end 27 through an outlet aperture 33.

The plate 32 of the strap engaging means or gripper 14 is integrally formed at approximately a right angle to a plate 35 which is pivotally affixed to a pin 36 secured to the handle 11. A torsion spring 37 wrapped about the pin 36 includes one end 38 pinched to the handle 11 and another end 39 pressing against the plate 32 and biasing the plate 32 toward double plate 31.

Plate 32 of the gripper 14 includes a discontinuous gripping edge 40 which bites into the straps 16 to pinch the strap 16 between it and the double plate 31 and pull the strap 16 through the locking collar 17 as the handles 11, 12 are swung relative to each other. The gripping relatively blunt edge 40 includes a discontinuous biting edge 41 which facilitates the biting into of the strap 16.

The plate 32 of the gripper 14 also includes an indent 50 with a planar blunt surface portion or ramp 51. The planar surface portion 51 lies in a plane oblique to the substantially planar surface 30. When the strap 16 is being gripped by the gripper 14, the planar surface portion 51 is disposed generally parallel to planar surface 29 and bears against the strap 16. As the blunt portion 51 bears against the strap 16, the discontinuous relatively blunt edge 40 and discontinuous biting edge 41 are prevented from slicing through and cutting the strap 16, but allowed to bite sufficiently into the strap 16 to pull the strap 16 to sufficiently high tensions.

The handle 12 includes a support arm 60 and a pressure lever 61. The support arm 60 opposes the front end 27 of the handle 11 and includes a guide pin 62 for guiding the cutting blade 13, a plate portion 63 against which the locking collar 17 bears and against which the cutting blade 13 slides, and an inlet aperture 64 formed in plate portion 63 for receiving the strap 16.

The support arm 60 also includes a blade extension 70 for bearing against and propelling the cutting blade 13 to cut the strap 16. The blade extension 70 is slidingly connected to a plate portion 71 of the support arm 60 via a pin 72. Pin 72 extends through a slot 73 formed in the plate portion 71.

The support arm 60 is connected to the pressure lever 61 via the quick release operating mechanism 15. The mechanism 15 includes a spring pressed ball detent means with a pair of breakaway flat springs 80 mounted on opposing sides of the pressure lever 61 by a pin connector 81. The pin connector 81 includes a diamond shaped knob 82 threaded onto one end of the pin connector 81. A torsion spring 83 with two ends 84, 85 is wrapped about the shaft of pin connector 81. One end 84 presses against a plate portion 86 of the support arm 60 and the other end 85 presses against a plate portion 87 of the pressure lever 61.

The operating mechanism 1 further includes balls 90 which are received in apertures 91 which are formed in the pressure lever 61. The diameter of the apertures 91 are substantially equal to or slightly greater than the diameter of the balls 90. The balls 90 are held in the apertures 91 by being pinched between the flat springs 80 and circular edges 92 of support arm 60 which form seats or apertures 93 of the balls 90. The diameter of the apertures 93 is less than the diameter of the balls 90. The spring pressed balls 90 remain set in apertures 93 and dispose the support arm 60 in a fixed relationship relative to the pressure lever 61. A turning of the knob 82 varies the pressure brought to bear on the flat springs 80 and hence varies the pressure that the flat springs 80 bring to bear on the balls 90, which in turn bring pressure to bear on the edges 92 forming the apertures 93 of the support arm 60.

The pressure lever 61 further includes a spacer or grommet 100 on a pin 101. The spacer 100 bears against an end of the blade extension 70 to propel the blade extension 70 with a snap action at the prescribed tension. The pressure lever 61 further includes a grip 102.

In operation, the strap 16 is strapped around the bundle of elements 18 or around the flexible air duct being joined to circular metal duct work. The strap 16 is then fed through its locking collar 17 and tightened manually. The knob 82 is then turned to press the flat springs 80 to the desired breakaway tension against the balls 90. Subsequently, the strap 16 is inserted into the inlet 64 of support arm 60 and between the double plate 31 and plate 32 of the gripper 14, and fed out of the outlet 33 until the locking collar 17 bears against the plate portion 63 of the support arm 60. With the strap 16 between the plates 31, 32, the edges 40, 41 bite into the strap 16 and pinch the strap 16 against the surface portion 29 of the double plate 31. As the handles 11, 12 are gripped and swung relative to each other, the flat springs 80 press the balls 90 against the edges 92 of the apertures 93 of the support arm 60 to maintain the support arm 60 and pressure lever 61 in a fixed linear relationship. Concurrently, the gripper 14 engages the strap 16 and pulls the strap 16 ever more tightly about the bundle of elements 18. As the tension of the strap 16 is increased, the edges 40, 41 bite even more firmly and deeply into the strap 16. Before the edges 40, 41 slice through or sever the strap 16 or bite sufficiently deeply to permit the strap 16 to break or tear, the blunt planar surface portion 51 of the indent 50 bears against the strap 16 to prevent the edges 40, 41 from penetrating further into the strap 16. As it becomes increasingly more difficult to pull the strap 16 through the collar 17 and hence to swing the handles 11, 12 relative to each other, the balls 90 snap out and break away from their seating apertures 93 and hence allow the handle 12 to articulate. As the pressure lever 61 articulates or tilts relative to the support arm 60, the spacer 100 pushes the blade extension 70 with a snap action to propel the cutting blade 13 to cut the strap 16 flush with the locking collar 17. As the handles 11, 12 are released, the tension spring 83 returns the pressure lever 61 to a linear relationship with the support arm 60, thereby allowing the balls 90 to be seated with a snap action back into their apertures 93 to fix the pressure lever 61 to the support arm 60 for tensioning yet another strap 16.

In an alternate embodiment of the invention, a tensioning and cut off tool 110 includes a pair of relatively swingable handles 111, 112 pivotally connected via a pin connector 113. A cutting blade 114 is slidably mounted in a front end 115 of the handle 112 and biased to a nonoperating position by a coil spring 116 affixed to a rear portion of handle 111.

A manually operable cut off lever 120 is swingably connected to the handle 112 via a pin connector 121. The lever 120 includes a grommet 122 on a pin 123 fixed to the lever 120. The grommet 122 bears against the cutting blade 114 when the lever 120 is swung relative to the handle 112 to propel the cutting blade 114 to cut a strap.

The tool 110 includes a front end 125 and strap engaging means or gripper 126 identical to the strap engaging means or gripper 14. A strap engages respective opposing planar surfaces 129, 130 of a double plate 131 of the front end 125 and a plate 132 of the strap engaging means 126.

The plate 132 of the strap engaging means or gripper 126 is integrally formed at approximately a right angle to a plate 135 which is pivotally affixed to a pin 136 secured to the handle 111. A torsion spring 137 wrapped about the pin 136 includes one end 138 pinched to the handle 111 and another end 139 pressing against the plate 132 and biasing the plate 132 toward double plate 131.

Plate 132 of the gripper 126 includes a discontinuous gripping edge 140 which bites into a strap to pinch the strap between it and the double plate 131 and pull the strap through a locking collar as the handles 111, 112 are swung relative to each other. The gripping relatively blunt edge 140 includes a discontinuous biting edge 141 which facilitates the biting into the strap.

The plate 132 of the gripper 126 also includes an indent 150 with a planar blunt surface portion 151. The planar surface portion 151 lies in a plane oblique to the substantially planar surface 130. When the strap is being gripped by the gripper 126, the planar surface portion 151 is disposed generally parallel to planar surface 129 and bears against the strap. As the blunt portion 151 bears against the strap, the discontinuous relatively blunt edge 140 and discontinuous biting edge 141 are prevented from slicing through and severing the strap, but allowed bit sufficiently into the strap to pull the strap to sufficiently high tensions.

In the operation of the alternate embodiment, the handles 111, 112 are swung relative to each other to tighten the strap. During the tensioning, the gripper 126 operates in like manner to the gripper 14 to pull the strap without severing the strap. When the strap has been tightened to the desired tension, the manual cut off lever 120 is swung relative to the handle 112 to cut the strap.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A tensioning and cut off tool for applying a strap wherein the strap has a locking collar and a free end, comprising a pair of swingable handles pivotally connected together, the handles having rear ends to be manually gripped and swung, and also having front ends with strap engaging means for gripping and tensioning the strap as the handles are swung toward each other, a cut off blade movably mounted on a portion of one of the handles to move against the strap for cutting the strap, one of the handles having a quick release operating mechanism connected with the blade for moving the blade against the strap when released, said operating mechanism releasing in response to a predetermined force manually applied to the handles as tension is applied to the strap, and said mechanism operating the blade when released to move the blade with a snap action to suddenly cut the strap, one of said handles including a support arm defining said blade mounting portion, said quick release operating mechanism including a pressure lever tiltably connected to the support arm, said pressure lever tilting on the support arm to produce movement of the blade for cutting the strap and the mechanism also including a pressure responsive releasable retainer normally retaining the pressure lever against tilting with respect to the support arm and releasing the lever for tilting when a predetermined pressure is applied on the lever causing swinging of the handle and resulting in predetermined pressure on the strap, and the quick release operating mechanism further including adjustment means for adjusting the predetermined force for releasing the operating mechanism such that the predetermined force for releasing the operating mechanism is variable.

2. A tensioning and cut off tool according to claim 1, wherein the adjustment means engages the pressure responsive releasable retainer.

3. A tensioning and cut off tool according to claim 1, wherein the releasable retainer comprises a spring pressed ball detent means connecting the support arm and pressure lever for releasably retaining the support arm and the pressure lever in the fixed relationship.

4. A tensioning and cut off tool according to claim 3, and wherein the releasable retainer includes relatively moving portions of the support arm and pressure lever, one of said moving portions having an indented seat, the other of said moving portions having a confining aperture aligned with the seat, a ball in the aperture and bearing on the seat, and a spring anchored on one of the portions and pressing the ball against the seat.

5. A tensioning and cut off tool according to claim 4, wherein the adjustment means includes a threaded pin connector engaging the spring and pressure lever, the pin connector including a knob threaded on the pin connector and bringing incremental pressure to bear on the spring and the ball, the knob being turnable to increase and decrease the incremental pressure.

6. A tensioning and cut off tool according to claim 3, wherein the adjustment means engages the spring pressed ball detent means.

7. A tensioning and cut off tool for applying a strap having a locking collar and a free end, comprising a pair of swingable handles pivotally connected together, the handles having rear ends to be manually gripped and swung, and also having front ends with strap engaging means for gripping and tensioning the strap as the handles are swung toward each other, a cut off blade movably mounted on a portion of one of the handles to move against the strap for cutting the strap, one of the handles having a quick release operating mechanism connected with the blade for moving the blade against the strap when released, said operating mechanism releasing in response to a predetermined force manually applied to the strap, and said mechanism operating the blade when released to move the blade with a snap action to suddenly cut the strap, one of the handles having means for resetting the operating mechanism to a fixed position from an operating position, the resetting means also returning the cut off blade to a rest position from an extended position, one of the handles being articulated and said front and rear ends being tiltably connected together for tilting between a rest position and an operating position, the tilting of said front and rear ends into operating position with respect to each other causing operation of said mechanism to move the blade for cutting the strap, said resetting means including a spring for returning the blade away from the strap when the front and rear ends of said one handle are returned to rest position, and the quick release operating mechanism including adjustment means for adjusting the predetermined force for releasing the operating mechanism such that the predetermined force for releasing the operating mechanism is variable.

8. A tensioning and cut off tool according to claim 7, wherein the adjustment means engages the articulated handle.

9. A tensioning and cut of tool for applying a strap wherein the strap has a locking collar and a free end, comprising a pair of swingable handles pivotally connected together, the handles having rear ends to be manually gripped and swung, and also having front ends with strap engaging means for gripping and tensioning the strap as the handles are swung toward each other, a cut off blade movably mounted on a portion of one of the handles to move against the strap for cutting the strap, one of the handles having a quick release operating mechanism connected with the blade for moving the blade against the strap when released, said operating mechanism releasing in response to a predetermined force manually applied to the handles as tension is applied to the strap, and said mechanism operating the blade when released to move the blade with a snap action to suddenly cut the strap, one of said handles including a support arm defining said blade mounting portion, said quick release operating mechanism including a pressure lever tiltably connected to the support arm, said arm tilting on the support arm to produce movement of the blade for cutting the strap and the mechanism also including a pressure responsive releasable retainer normally retaining the pressure lever against the tilting with respect to the support arm and releasing the lever for tilting when a predetermined pressure is applied on the lever causing swinging of the handle and resulting in predetermined pressure on the strap, and the strap engaging means being swingable and including an edge that engages the strap during the gripping and tensioning of the strap, the edge having an indent for decreasing the overall length of the edge and thereby minimizing the chances of a severing of the strap by the strap engaging means.

10. A tensioning and cut off tool according to claim 9, wherein the edge is disposed in a first plane and the indent includes a surface area disposed in a second plane oblique to the first plane.

11. A tensioning and cut off tool according to claim 9, wherein the strap engaging means includes a spring pressed piece pivotally mounted on one of the front ends, the piece including the edge with the indent.

12. A tensioning and cut off tool for applying a strap having a locking collar and a free end, comprising a pair of swingable handles pivotally connected together, the handles having rear ends to be manually gripped and swung, and also having front ends with strap engaging means for gripping and tensioning the strap as the handles are swung toward each other, a cut off blade movably mounted on a portion of one of the handles to move against the strap for cutting the strap, one of the handles having a quick release operating mechanism connected with the blade for moving the blade against the strap when released, said operating mechanism releasing in response to a predetermined force manually applied to the strap, and said mechanism operating the blade when released to move the blade with a snap action to suddenly cut the strap, one of the handles having means for resetting the operating mechanism to a fixed position from an operating position, the resetting means also returning the cut off blade to a rest position from an extended position, one of the handles being articulated and said front and rear ends being tiltably connected together for tilting between a rest position and an operating position, the tilting of said front and rear ends into operating position with respect to each other causing operation of said mechanism to move the blade for cutting the strap, said resetting means including a spring for returning the blade away from the strap when the front and rear ends of said one handle are returned to rest position, and the strap engaging mean being swingable and including a discontinuous edge that engages the strap during the gripping and tensioning of the strap for minimizing the chances of a severing of the strap by the strap engaging means.

13. A tensioning and cut off tool according to claim 12, wherein a first portion of the edge is disposed in a first plane and a second portion of the edge is disposed in a second plane oblique to the first plane.

14. A tensioning and cut off tool according to claim 12, wherein the strap engaging means includes a spring pressed piece pivotally mounted on one of the front ends, the piece including the discontinuous edge.

* * * * *

UNITED STATES PATENT AND TRADEMARK OFFICE

CERTIFICATE OF CORRECTION

PATENT NO. : 5,048,575

DATED : September 17, 1991

INVENTOR(S) : Lester N. Smith

It is certified that error appears in the above-identified patent and that said Letters Patent is hereby corrected as shown below:

Title Page:
In the ABSTRACT, at line 11, delete "of" (first occurrence), and substitute --for--.

In column 3, line 47, delete "1", and substitute --15--.

In column 7, line 9, delete "of", and substitute --off--.

Signed and Sealed this

Sixth Day of July, 1993

*Attest:*

Michael K. Kirk

MICHAEL K. KIRK

*Attesting Officer*

*Acting Commissioner of Patents and Trademarks*